US007464467B2

(12) United States Patent
Fukuyama

(10) Patent No.: US 7,464,467 B2
(45) Date of Patent: Dec. 16, 2008

(54) METHOD FOR MANUFACTURING SHEET-CONVEYING ROLLER

(75) Inventor: Shoichi Fukuyama, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 587 days.

(21) Appl. No.: 10/936,482

(22) Filed: Sep. 9, 2004

(65) Prior Publication Data

US 2005/0050728 A1 Mar. 10, 2005

(30) Foreign Application Priority Data

Sep. 9, 2003 (JP) ..... 2003-316438

(51) Int. Cl.
*B21K 1/02* (2006.01)
*G03G 15/08* (2006.01)

(52) U.S. Cl. ..... 29/895.22; 29/895; 29/895.2; 399/279

(58) Field of Classification Search ..... 29/895, 29/895.2, 895.21, 895.22, 895.3, 895.32; 492/48, 60; 399/16, 124, 279, 388
See application file for complete search history.

(56) References Cited

U.S. PATENT DOCUMENTS 4,144,812 A * 3/1979 Julian ..... 101/382.1
5,133,125 A * 7/1992 Diebels et al. ..... 29/527.2
5,237,747 A * 8/1993 Nakashima ..... 29/895.32
5,548,897 A * 8/1996 Link ..... 29/895.32
5,594,531 A * 1/1997 Shishido et al. ..... 399/154
5,842,962 A * 12/1998 Yamada et al. ..... 492/18
6,200,043 B1 * 3/2001 Inoue et al. ..... 400/88
6,213,464 B1 * 4/2001 Inoue et al. ..... 271/248
6,381,429 B1 * 4/2002 Shibata et al. ..... 399/117
6,440,048 B1 * 8/2002 Bleil et al. ..... 492/46
6,604,462 B2 * 8/2003 Achelpohl ..... 101/216
6,681,096 B2 * 1/2004 Seto et al. ..... 399/388
6,716,148 B1 * 4/2004 Fortin et al. ..... 492/47

(Continued)

FOREIGN PATENT DOCUMENTS

JP 61037330 A * 2/1986

(Continued)

OTHER PUBLICATIONS

Japanese Office Action dated Oct. 18, 2006 with English translation (Seven (7) pages).

Japanese Office Action dated Jul. 20, 2006 with English translation (Five (5) pages).

*Primary Examiner*—Essama Omgba
(74) *Attorney, Agent, or Firm*—Crowell & Moring LLP

(57) ABSTRACT

A method is provided for manufacturing a sheet-conveying roller, which includes a roller shaft having a pipe-shaped roller body on an outer circumference of which a resin layer is formed, and bearing members made of resin being attached to both end portions of the roller shaft and having press-fitted portion and a bearing portion. The method includes: press-fitting the press-fitted portion into the both end portions of the roller shaft; cutting a portion of the press-fitted portion of the bearing members being press-fitted into the roller shaft, the portion protruding from the roller body; aligning axis of the sheet-conveying roller by cutting an outer circumference of the press-fitted portion press-fitted into the roller shaft; and cutting an end face of the bearing portion.

4 Claims, 2 Drawing Sheets

U.S. PATENT DOCUMENTS

| | | | | |
|---|---|---|---|---|
| 6,988,723 | B2 * | 1/2006 | Kitami et al. | 271/127 |
| 2004/0242392 | A1 * | 12/2004 | Betti et al. | 492/28 |
| 2008/0107454 | A1 * | 5/2008 | Fukuyama | 399/279 |

FOREIGN PATENT DOCUMENTS

| | | | |
|---|---|---|---|
| JP | 4-173365 | | 6/1992 |
| JP | 07-259816 | A | 10/1995 |
| JP | 9-66401 | A | 3/1997 |
| JP | 09086712 | A * | 3/1997 |
| JP | 10-218416 | A | 8/1998 |
| JP | 10-281140 | | 10/1998 |
| JP | 11255368 | A * | 9/1999 |
| JP | 2000-264480 | A | 9/2000 |
| JP | 2001-253582 | A | 9/2001 |
| JP | 2005314048 | A * | 11/2005 |

* cited by examiner

METHOD FOR MANUFACTURING SHEET-CONVEYING ROLLER

BACKGROUND OF THE INVENTION

1. Field of the Invention

The present invention relates to a method for manufacturing a sheet-conveying roller that conveys sheets on which an image is formed, the sheet-conveying roller used in an image forming apparatus such as a laser beam printer. The present invention is also related to an image forming apparatus in which the sheet-conveying roller is used. More particularly, the present invention relates to a method of obtaining a sheet-conveying roller, the weight of which is small and the machining accuracy of which is high.

2. Description of the Related Art

As well known, for example, in an image forming apparatus such as a laser beam printers a feed motor for feeding sheets and an image forming means are operated according to control data and image forming data which are sent from a host computer such as a personal computer (PC), and the sheets supplied by a conveyance unit, which is arranged on the upstream side, are sent out at a predetermined pitch to a predetermined image forming position on a base frame of the image forming means, which is arranged on the downstream side, by a feed roller driven by the feed motor, and an image such as a predetermined character or figure is formed on the sheet at a predetermined image forming position by the image forming means. Accordingly, it is necessary for a sheet-conveying roller, especially for the feed roller to feed a sheet so that it cannot deviate from a predetermined feeding passage. Therefore, the feed roller is highly accurately machined for alignment so that the deviation cannot be caused. Further, it is necessary for the outer diameter of the feed roller to be formed uniform, that is, it is necessary for the dimensions of the feed roller to be maintained uniform. For the above reasons, it is common that the feed roller is made out of a solid round bar by means of cutting. However, this type of feed roller goes against a demand of reducing the weight of the apparatus.

From the above viewpoints, in order to reduce the weight, a roller is conventionally provided in which a shaft is press-fitted into a hollow portion of a pipe-shaped roller, and a circumferential face of a flange portion of the shaft and an inner face of the roller are bonded to each other or caulked to each other by a caulking machine (see JP-A-04-173365) Further, another roller is conventionally provided in which a shaft is engaged inside a cylindrical roller, and an end portion of the roller and the shaft are fixed to each other being welded by fillet welding (see JP-A-10-281140).

SUMMARY OF THE INVENTION

However, according to the configuration described in the documents JP-A-04-173365 and JP-A-10-281140, after the shaft has been press-fitted into the roller, the roller and the shaft are fixed to each other only by means of adhesion, caulking or fillet welding. Therefore, alignment of the roller cannot be sufficiently accomplished, that is, accurate alignment can not be attained. Further, since the shaft is made of metal, it is impossible to greatly reduce the weight.

The present invention has been accomplished to solve the above conventional problems. It is an object of the present invention to provide a method for manufacturing a sheet-conveying roller, the weight of which is small and the machining accuracy of which is high. It is another object of the present invention to provide an image forming apparatus into which the sheet-conveying roller is mounted.

According to a first aspect of the invention, there is provided a method for manufacturing a sheet-conveying roller including: a roller shaft having a pipe-shaped roller body on an outer circumference of which a resin layer is formed; and bearing members made of resin being attached to both end portions of the roller shaft and having press-fitted portion and a bearing portion, the method including: press-fitting the press-fitted portion into the both end portions of the roller shaft; cutting a portion of the press-fitted portion of the bearing members being press-fitted into the roller shaft, the portion being protruded from the roller body; aligning an axis of the sheet-conveying roller by cutting an outer circumference of the bearing portion; and cutting an end face of the bearing portion.

According to a second aspect of the invention, there is provided an image forming apparatus including: a sheet-conveying roller that conveys sheets; and a printing unit that forms an image on the sheets conveyed by the sheet-conveying roller, wherein the sheet-conveying roller includes: a roller shaft having a pipe-shaped roller body on an outer circumference of which a resin layer is formed; and bearing members made of resin being attached to both end portions of the roller shaft and having press-fitted portion and a bearing portion, and wherein the sheet-conveying roller is manufactured by a method including: press-fitting the press-fitted portion into the both end portions of the roller shaft; cutting a portion of the press-fitted portion of the bearing members being press-fitted into the roller shaft, the portion being protruded from the roller body; aligning an axis of the sheet-conveying roller by cutting an outer circumference of the bearing portion; and cutting an end face of the bearing portion.

BRIEF DESCRIPTION OF THE DRAWINGS

The above objects and advantages of the present invention will become more apparent by describing a preferred exemplary embodiment thereof in detail with reference to the accompanying drawings, wherein.

DETAILED DESCRIPTION OF THE PREFERRED EMBODIMENTS

Referring now to the accompanying drawings, a description will be given in detail of preferred embodiments of the invention.

In the embodiment, there is applied a method for manufacturing a sheet-conveying roller, and the roller includes a roller shaft, which includes a pipe-shaped roller body, on the outer circumference of which a resin layer is formed, and bearings made of resin are attached to both end portions of the roller shaft. The method includes the steps of: press-fitting the bearings, which have been previously formed into a tapered shape, into both end portions of the roller shaft; cutting a portion of the press-fitted portion which is protruding from the roller body; aligning axis of the sheet-conveying roller by cutting an outer circumference of the bearing; cutting an end face of the bearing; and chamfering an end portion of the resin layer of the roller shaft.

Figure 1:
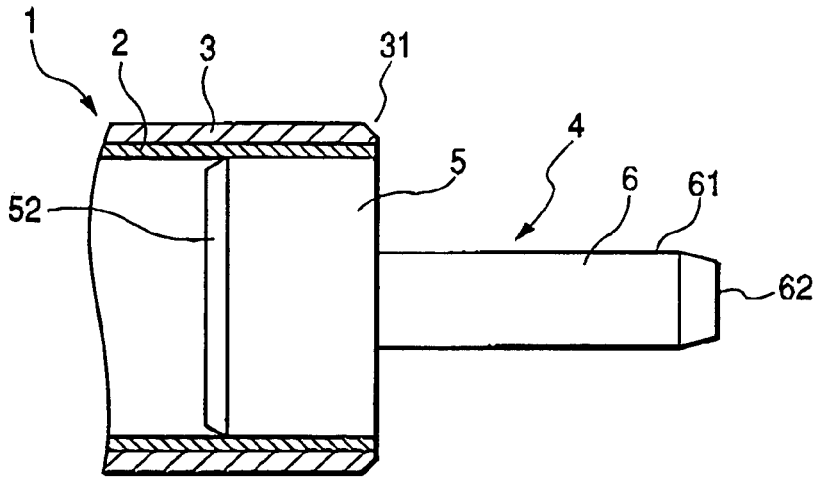
FIG. 1 is an enlarged sectional view showing a primary portion of a sheet-conveying roller of an embodiment of the invention.
Figure 2:
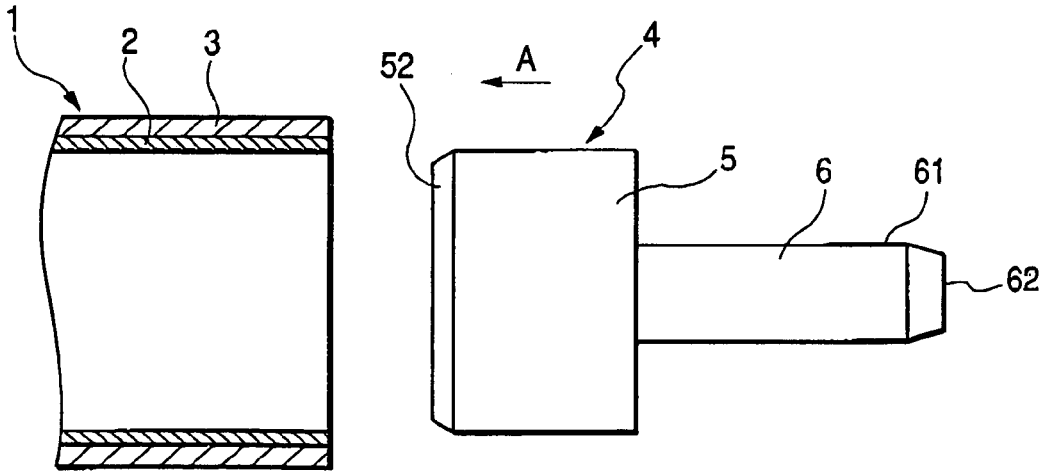
FIG. 2 is an enlarged sectional view showing a state immediately before a bearing is press-fitted and engaged in a roller shaft.
Figure 3:
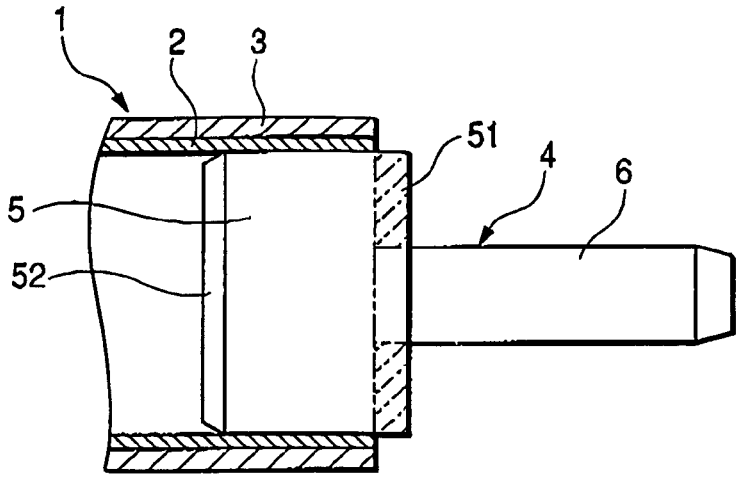
FIG. 3 is an enlarged sectional view showing a state immediately after the bearing has been press-fitted and engaged in the roller shaft.
Figure 4:
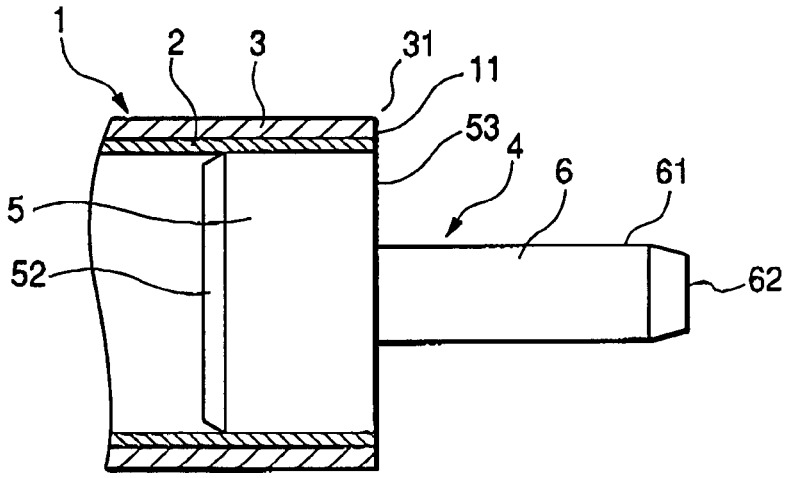
FIG. 4 is an enlarged sectional view showing a state immediately after a portion of the press-fitted portion of the bearing, which is protruding, has been cut away.
Figure 5:
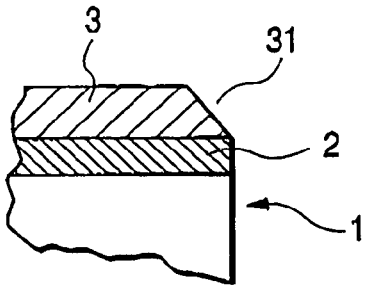
FIG. 5 is a partially enlarged view showing a portion of the end portion of the resin layer on the roller shaft which has been chamfered.

FIG. 1 is an enlarged sectional view showing a primary portion of the sheet-conveying roller of the embodiment, FIG. 2 is an enlarged sectional view showing a state immediately before the bearing is press-fitted and engaged in the roller shaft, FIG. 3 is an enlarged sectional view showing a state immediately after the bearing has been press-fitted and engaged in the roller shaft, FIG. 4 is an enlarged sectional view showing a state immediately after a portion of the press-fitted portion of the bearing, which is protruding, has been cut away, and FIG. 5 is a partially enlarged view showing a portion of the end portion of the resin layer on the roller shaft which has been chamfered.

Reference numeral 1 is a roller shaft. Bearings 4 made of resin are respectively press-fitted into both end portions of the sheet-conveying roller shaft 1 to compose a roller used for conveying sheets. The aforementioned roller shaft 1 is composed in such a manner that the resin layer 3 made of synthetic resin is coated on an outer circumference of the pipe-shaped roller body 2 made of metal such as iron, aluminum or stainless steel. Examples of synthetic resin composing this resin layer 3 are: ABS resin (having a special structure in which special acrylic rubber, acrylonitrile and styrene are used as the main material), polypropylene and polyester. The bearing 4 made of resin includes a press-fitted portion 5 and a shaft portion 6. The bearing 4, which is made of the same resin described above, is integrally molded by a metallic die. When necessary, a forward end portion 52 of the press-fitted portion 5 of this bearing 4 may be formed into a tapered shape in the process of resin molding by forming a related portion of the metallic die to be tapered.

According to the method for manufacturing a sheet-conveying roller of the invention, in the state shown in FIG. 2, the bearing 4 made of resin, the forward end portion 52 of the press-fitted portion 5 of which has been previously formed into a tapered shape, is press-fitted into both end portions of the roller shaft 1 in the direction shown by arrow A, so that the state can be changed into the state shown in FIG. 3. Under this state, the portion 51 of the press-fitted portion 5 of the bearing 4, which is protruding from the roller body 2, is subjected to cutting by a cutter so that the end face 11 of the roller shaft 1 and the end face 53 of the press-fitted portion 5 of the bearing 4 can be aligned as shown in FIG. 4. In the cutting process, when necessary, the end face 11 of the roller shaft 1 and the end face 53 of the press-fitted portion 5 of the bearing 4 may be simultaneously cut so that both end faces 11, 53 can be aligned to each other. After that, the outer circumference 61 of the bearing portion 6 of the bearing 4 is cut with the cutter, so that the sheet-conveying roller can be aligned. Successively, the end face 62 of the bearing portion 6 is shaved. Finally, when necessary, as shown in FIG. 5, the corner portion of the end portion 31 of the resin layer 3 of the roller shaft 1 is chamfered. When this chamfering is conducted, lack of uniformity of the end portion, which is caused at the time of forming the resin layer 3, can be removed. Therefore, the resin layer 3 can be finely finished and tightly contacted with sheets at the time of sheet conveyance. Accordingly, there is no possibility of the occurrence of failure of sheet conveyance, which is convenient for the sheet conveyance.

In the case where the above sheet-conveying roller of the present invention is used, for example, as a feed roller, a gear not shown, which transmits a drive force from the feed motor for feeding sheets, is attached to the bearing 4 of the bearing portion 6.

In the embodiment having the above structure, the bearing 4 of the roller is made of resin and further press-fitted into the roller body 2. Therefore, the weight can be reduced, and the bearing 4 can be strongly fixed into the roller body 2. Further, after the bearing 4 has been press-fitted into the roller body 2, the portion 51 of the press-fitted portion 5 of the bearing 4, which is protruding from the roller body 2, is subjected to cutting so that the roller can be aligned, and the end face 62 of the bearing portion 6 is shaved and the end portion 31 of the resin layer 3 of the roller shaft 1 is successively chamfered. Therefore, the outer diameter and the outer dimensions can be formed uniform. Accordingly, alignment of the roller can be highly accurately made.

The weight of the sheet-conveying roller of an image forming apparatus can be reduced. Further, since the image forming apparatus uses the above roller which has been machined with high accuracy, sheets can be precisely conveyed by the image forming means for image formation. Therefore, predetermined characters and figures can be formed at predetermined image forming position by the image forming means. Further, a reduction of the weight of this type apparatus can be facilitated.

The sheet-conveying roller of the present invention has been developed for the use of a feed roller. However, the sheet-conveying roller of the present invention can be used for other rollers of the image forming apparatus, for example, when the sheet-conveying roller of the present invention is used as a sheet feed roller, a squeeze roller or a sheet discharge roller, of course, the function of the roller can be sufficiently exhibited.

In this connection, the embodiment described above is a preferred embodiment of the present invention. It should be noted that the present invention is not limited to the above specific embodiment. Variations may be made by those skilled in that art without departing from the spirit and scope of the present invention.

According to a first aspect, there is provided a method for manufacturing a sheet-conveying roller, the roller including a roller shaft, which includes a pipe-shaped roller body, on the outer circumference of which a resin layer is formed, bearings made of resin being attached to both end portions of the roller shaft, the method comprising the steps of: press-fitting the bearings into both end portions of the roller shaft; cutting a portion of the press-fitted portion of the bearing which is protruding from the roller body; aligning axis of the sheet-conveying roller by cutting an outer circumference of the bearing; cutting an end face of the bearing portion; and chamfering an end portion of the resin layer of the roller shaft.

According to the above configuration, the bearing of the roller is made of resin. Further, the bearing of the roller is press-fitted and engaged in the roller body. Therefore, the weight can be reduced, and further the bearing of the roller and the roller body are strongly fixed to each other. Further, after the bearing has been press-fitted into the roller body, a press-fitted portion of the bearing, which is protruding from the roller body, is cut away, the roller is aligned, an end face of the bearing is shaved, and an end face of the resin layer on the roller shaft is chamfered. Therefore, the diameter of the roller body can be made uniform, that is, the outer dimensions can be made uniform, and machining for aligning the roller can be highly accurately conducted. Further, an irregular shape of the end portion, which is generated at the time of forming the resin layer, can be removed. Therefore, the resin layer can be finely finished, and the roller can tightly come into contact with sheets at the time of conveying the sheets. Accordingly, there is no possibility of the occurrence of failure of the conveyance of sheets.

According to a second aspect, there is provided a method for manufacturing a sheet-conveying roller, the roller including a roller shaft, which includes a pipe-shaped roller body, on the outer circumference of which a resin layer is formed, bearings made of resin being attached to both end portions of the roller shaft, the method comprising the steps of: press-fitting the bearings into both end portions of the roller shaft; cutting a portion of the press-fitted portion of the bearing which is protruding from the roller body; aligning axis of the sheet-conveying roller by cutting an outer circumference of the bearing; and cutting an end face of the bearing portion.

According to the above configuration, the bearing of the roller is made of resin. Further, the bearing of the roller is press-fitted and engaged in the roller body. Therefore, the weight can be reduced, and further the bearing of the roller and the roller body are strongly fixed to each other. Further, after the bearing has been press-fitted into the roller body, a press-fitted portion of the bearing, which is protruding from the roller body, is cut away, the roller is aligned, an end face of the bearing is shaved, and an end-face of the resin layer on the roller shaft is chamfered. Therefore, the diameter of the roller body can be made uniform, that is, the outer dimensions can be made uniform, and machining for aligning the roller can be highly accurately conducted.

According to a third aspect, there is provided a method for manufacturing a sheet-conveying roller, in which a forward end portion of the press-fitted portion of the bearing is previously formed into a tapered shape.

According to the above configuration, a forward end portion of the press-fitted portion of the bearing is previously formed into a tapered shape. Therefore, the bearing can be very easily press-fitted into the roller body, which is convenient for the assembling work.

According to a fourth aspect, there is provided a method for manufacturing a sheet-conveying roller, in which the sheet-conveying roller is a feed roller to feed sheets, which are supplied from a conveyance unit arranged on the upstream side, to a printing unit arranged on the downstream side at a predetermined pitch.

According to the above configuration, it is possible to highly accurately manufacture a feed roller for feeding sheets, which have been supplied from the conveyance unit on the upstream side, to the printing unit on the downstream side at a predetermined pitch. Therefore, this configuration can be preferably adopted.

According to a fifth aspect, there is provided an image forming apparatus including a sheet-conveying roller, a predetermined image being printed by a printing unit on the sheets conveyed by the roller, the roller comprising: a roller shaft, on the outer circumference of the pipe-shaped roller body of which a resin layer is formed; and bearings made of resin arranged at both end portions of the roller shaft, wherein the bearings are press-fitted into both end portions of the roller shaft, a portion of the press-fitted portion of the bearing protruding from the roller body is cut away, alignment is conducted by cutting an outer circumference of the bearing portion of the bearing, an end face of the bearing portion is shaved, and an end portion of the resin layer on the roller shaft is chamfered.

According to the above configuration, the weight of the sheet-conveying roller of an image forming apparatus can be reduced. Further, it is possible to use a roller which has been highly accurately machined. Therefore, sheets, which are conveyed to the image forming means for the formation of images, can be accurately conveyed. Accordingly, images of predetermined characters and figures can be formed at predetermined image forming positions on the sheets. Further, the weight of this type of apparatus can be reduced.

According to a sixth aspect, there is provided an image forming apparatus including a feed roller to feed sheets, which are supplied from a conveyance unit arranged on the upstream side, to a predetermined printing position on a base frame of a printing unit arranged on the downstream side, the image forming apparatus forming a predetermined image on the sheet by the printing unit, the feed roller comprising: a roller shaft, on the outer circumference of the pipe-shaped roller body of which a resin layer is formed; and bearings made of resin arranged at both end portions of the roller shaft, wherein the bearings are press-fitted into both end portions of the roller shaft, a portion of the press-fitted portion of the bearing protruding from the roller body is cut away, alignment is conducted by cutting an outer circumference of the bearing portion of the bearing, an end face of the bearing portion is shaved, and an end portion of the resin layer on the roller shaft is chamfered.

According to the above configuration, the weight of a feed roller, which feeds sheets sent from the conveyance unit on the upstream side to a predetermined printing position on the base frame of the printing unit on the downstream side by a predetermined pitch, can be reduced. Further, a highly accurately machined roller is used. Therefore, the sheets conveyed to the image forming means for image formation can be accurately conveyed to the image forming position. Accordingly, predetermined characters and figures are formed on the sheets by the image forming means, and a reduction in the weight of this type of apparatus can be facilitated.

According to a seventh aspect, there is provided an image forming apparatus, in which a forward end portion of the press-fitted portion of the bearing is formed into a tapered shape.

According to the above configuration, a forward end portion of the press-fitted portion of the bearing is previously formed into a tapered shape. Therefore, the bearing can be very easily press-fitted into the roller body, which is convenient for the assembling.

Although the present invention has been shown and described with reference to a specific preferred embodiment, various changes and modifications will be apparent to those skilled in the art from the teachings herein. Such changes and modifications as are obvious are deemed to come within the spirit, scope and contemplation of the invention as defined in the appended claims.

What is claimed is:

1. A method for manufacturing a sheet-conveying roller including: a roller shaft having a pipe-shaped roller body on an outer circumference of which a resin layer is formed; and bearing members made of resin being attached to both end portions of the roller shaft and having a press-fitted portion and a bearing portion, the method comprising:

press-fitting the press-fitted portion into both end portions of the roller shaft, wherein a portion of the press-fitted portion protrudes from the roller body;

cutting the portion of the press-fitted portion of the bearing members which protrudes from the roller body;

aligning an axis of the sheet-conveying roller by cutting an outer circumference of the bearing portion after press-fitting the press-fitted portion; and cutting an end face of the bearing portion.

2. The method according to claim 1 further comprising chamfering an end portion of the resin layer.

3. The method according to claim 1, further comprising forming a forward end portion of the press-fitted portion into a tapered shape before press-fitting the press-fitted portion into both end portions of the roller shaft.

4. The method according to claim 1, wherein the sheet-conveying roller is a feed roller for feeding sheets at a predetermined pitch, the sheets supplied from a conveyance unit arranged on an upstream side with respect to a conveyance direction of the sheets, to a printing unit arranged on a downstream side with respect to the conveyance direction.

* * * * *